US011233346B2

(12) United States Patent
Gondo

(10) Patent No.: US 11,233,346 B2
(45) Date of Patent: Jan. 25, 2022

(54) BOARD-TO-BOARD CONNECTOR

(71) Applicant: Molex, LLC, Lisle, IL (US)

(72) Inventor: Daishi Gondo, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/839,090

(22) Filed: Apr. 3, 2020

(65) Prior Publication Data

US 2020/0343660 A1 Oct. 29, 2020

Related U.S. Application Data

(60) Provisional application No. 62/838,345, filed on Apr. 25, 2019.

(30) Foreign Application Priority Data

Jul. 22, 2019 (JP) ..... JP2019-134425

(51) Int. Cl.
*H01R 12/71* (2011.01)
*H01R 12/57* (2011.01)
(Continued)

(52) U.S. Cl.
CPC ..... *H01R 12/716* (2013.01); *H01R 12/57* (2013.01); *H01R 12/707* (2013.01);
(Continued)

(58) Field of Classification Search
CPC .... H01R 12/57; H01R 12/716; H01R 12/707; H01R 13/447; H01R 13/6275; H01R 13/631; H01R 13/6395
See application file for complete search history.

(56) References Cited

U.S. PATENT DOCUMENTS

D696,201 S 12/2013 Takenaga et al.
D737,213 S 8/2015 Yoshioka
(Continued)

FOREIGN PATENT DOCUMENTS

CN 202651402 U 1/2013
CN 106058518 A 10/2016
(Continued)

OTHER PUBLICATIONS

Office Action received for CN Application No. 202010321858.3, dated May 13, 2021, 13 Pages.(7 Pages of English Translation and 6 Pages of Official notification).
(Continued)

*Primary Examiner* — Oscar C Jimenez

(57) ABSTRACT

A connector body includes a mating guide part having a mating recess, a reinforcing bracket includes a body part attached to the outer side of an end wall part of the mating guide part, an end wall cover part connected to an upper end of the body part and covers an upper side and an inner side of the end wall part, and a contact arm connected to a lower end of the end wall cover part, the contact arm includes a bottom surface part extending along a bottom surface of the mating recess and an upright part extending upward from a tip of the bottom surface part, and the upright part includes a contact projection near a tip thereof, the contact projection extending toward the center in the width direction of the connector body.

7 Claims, 7 Drawing Sheets

(51) Int. Cl.

| | |
|---|---|
| ***H01R 12/70*** | (2011.01) |
| ***H01R 13/639*** | (2006.01) |
| ***H01R 13/631*** | (2006.01) |
| ***H01R 13/627*** | (2006.01) |
| ***H01R 13/447*** | (2006.01) |

(52) U.S. Cl.
CPC ..... *H01R 13/447* (2013.01); *H01R 13/6275* (2013.01); *H01R 13/631* (2013.01); *H01R 13/6395* (2013.01)

(56) References Cited

U.S. PATENT DOCUMENTS

| | | | | |
|---|---|---|---|---|
| D743,905 | S | 11/2015 | Kobuchi et al. | |
| D745,463 | S | 12/2015 | Kobuchi et al. | |
| 9,666,963 | B2 * | 5/2017 | He | H01R 12/7088 |
| 10,333,239 | B2 * | 6/2019 | Ashibu | H01R 13/115 |
| D878,301 | S | 3/2020 | Yamada et al. | |
| D885,347 | S | 5/2020 | Ishida | |
| 10,651,581 | B1 * | 5/2020 | Sasayama | H01R 4/02 |
| 10,673,159 | B2 | 6/2020 | Ishida | |
| 10,847,917 | B2 | 11/2020 | Ishida | |
| D908,635 | S | 1/2021 | Takenaga | |
| D908,636 | S | 1/2021 | Takenaga | |
| D917,399 | S | 4/2021 | Yanase et al. | |
| 2017/0264048 | A1 * | 9/2017 | Ashibu | H01R 12/716 |
| 2019/0363467 | A1 * | 11/2019 | Ko | H01R 12/57 |
| 2020/0235506 | A1 * | 7/2020 | Hosoda | H01R 12/716 |
| 2020/0358213 | A1 * | 11/2020 | Tanaka | H01R 12/716 |
| 2020/0412039 | A1 | 12/2020 | Chen et al. | |
| 2021/0005990 | A1 | 1/2021 | Zhang et al. | |

FOREIGN PATENT DOCUMENTS

| | | | |
|---|---|---|---|
| CN | 207459293 | U | 6/2018 |
| JP | 4478690 | B2 | 6/2010 |
| JP | 2015-122189 | A | 7/2015 |
| JP | 2016-146255 | A | 8/2016 |
| TW | D195135 | S | 1/2019 |
| TW | D196233 | S | 3/2019 |

OTHER PUBLICATIONS

Molex Connector Part No.: 513381674, Available from internet URL: https://www.molex.com/molex/products/part-detail/pcb_receptacles/0513381674, Nov. 24, 2021, 10 pages.

Non Final Office Action received for U.S. Appl. No. 29/747,850, dated Dec. 7, 2021, 08 Pages

* cited by examiner

Prior art

BOARD-TO-BOARD CONNECTOR

RELATED APPLICATION

This application claims priority to Japanese Application Serial No. 2019-134425, filed on Jul. 22, 2019 and U.S. Provisional application No. 62/838,345 filed on Apr. 25, 2019, which are incorporated by reference in their entirety.

TECHNICAL FIELD

The present disclosure relates to a connector.

BACKGROUND ART

Conventionally, connectors such as board to board connectors, etc., have been used to electrically connect pairs of parallel circuit boards together. These types of connectors are attached to mutually facing surfaces on pairs of circuit boards and provide conduction when mated together (for example see patent document 1).

FIG. 7 is a partially exploded perspective view illustrating a known connector.

In the drawing, 811 is a connector housing mounted on a circuit board (not illustrated), which has a pair of narrow long side wall parts 814 extending in the longitudinal direction and a projection 813 extending in the longitudinal direction disposed between the pair of side wall parts 814. Furthermore, elongated recessed grooves 812 extending in the longitudinal direction are formed between the side wall parts 814 on both sides of the projection 813, and a plurality of terminals 861 are aligned and attached in the recessed grooves 812 in the longitudinal direction of the connector.

When the connector is mated with the counterpart connector (not illustrated), a pair of projections formed on a counterpart housing of a counterpart connector is inserted into the respective recessed grooves 812. Thus, the terminals 861 come into contact with respective counterpart terminals (not illustrated) aligned with and attached to the projections, and become conductive the counterpart terminals.

A mating guide part 821 is formed on both longitudinal ends of the housing 811, and a mating recess 822 coupled to the recessed groove 812 is formed in the mating guide part 821. A reinforcing bracket 851 that functions as a power supply terminal is attached to the mating guide part 821. The reinforcing bracket 851 includes a body part 853 that extends in a width direction of the housing 811, a curved part 854 that is bent and extends from the upper end of the central part of the body part 853 toward the inner side of the mating recess 822, and a first elastic arm 855 and a second elastic arm 856 that are bent and extend from upper ends on both left and right ends of the body part 853 toward the inner side of the mating recess 822.

The first elastic arm 855 extends from one end toward the other end of the mating recess 822 in the width direction of the housing 811, and the free end thereof is a first contact part 855*a* that comes into contact with a counterpart reinforcing bracket (not illustrated) of the counterpart connector. The second elastic arm 856 extends within the mating recess 822 in a direction opposite to the first elastic arm 855, and the free end thereof is a second contact part 856*a* that comes into contact with a counterpart reinforcing bracket (not illustrated) of the counterpart connector. The first contact part 855*a* and the second contact part 856*a* are disposed so as to face each other on left and right inner walls of the mating recess 822. Note that the first elastic arm 855 and the second elastic arm 856 are aligned in the mating recess 822 in the longitudinal direction of the connector.

As a result, when the connector is mated with the counterpart connector (not illustrated), a mating projection (not illustrated) of the counterpart connector is inserted into the mating recess 822, and the counterpart reinforcing bracket disposed on the mating recess comes into contact with the left and right first contact parts 855*a* and the second contact part 856*a*. Accordingly, the power line connected to the counterpart reinforcing bracket becomes conductive with the power line connected to the reinforcing bracket 851.

Patent Document 1: Japanese Unexamined Patent Application Publication No. 2015-122189

SUMMARY

However, in the known connector, the first elastic arm 855 and the second elastic arm 856 that extend in the width direction of the connector are aligned in the mating recess 822 in the longitudinal direction of the connector, thereby complicating the structure. Further, when the overall length of the connector is reduced for miniaturization, the widths of the first elastic arm 855 and the second elastic arm 856 are reduced to decrease a spring force. As a result, the contact pressure of the first contact part 855*a* and the second contact part 856*a* onto the counterpart reinforcing bracket becomes small, making contact with the counterpart reinforcing bracket unreliable. Note that when it is attempted to increase the contact pressure of the first contact part 855*a* and the second contact part 856*a* onto the counterpart reinforcing bracket, the widths of the first elastic arm 855 and the second elastic arm 856 are increased to increase the entire length of the connector.

Here, an objective is to resolve the problems of the known connector, and to provide an easy-to-manufacture, small-sized, and highly reliable connector with a simple configuration that can ensure the spring length of a contact arm so as to exhibit a spring force required to apply a contact pressure to a contact projection.

Thus, a connector includes a connector body, a terminal attached to the connector body, and a reinforcing bracket attached to the connector body. The connector body includes mating guide parts formed at both longitudinal ends, the mating guide part including a mating recess into which counterpart mating guide part formed on both longitudinal ends of a counterpart connector body of a counterpart connector is inserted. The reinforcing bracket includes: a body part extending in a width direction of the connector body, the body part being attached to an outside of an end wall part of the mating guide part; an end wall cover part connected to an upper end of the body part, the end wall cover part covering at least a part of an upper side and an inner side of the end wall part; and a pair of elastically deformable contact arms connected to a lower end of the end wall cover part. Each of the contact arms includes: a bottom surface part extending along a bottom surface of the mating recess, and an upright part extending upward from a tip of the bottom surface part. The bottom surface part includes: a vertical part extending from a lower end of the end wall cover part toward a center in the longitudinal direction of the connector body, and a horizontal part extending from a tip of the vertical part toward an outer side in the width direction of the connector body, and the upright part includes a contact projection formed at a tip, the contact projection extending toward a center in the width direction of the connector body.

In another connector, the reinforcing bracket includes a recess cover part connected to the lower end of the end wall cover part, the recess cover part covering at least a part of the bottom surface of the mating recess, and the recess cover part is disposed between vertical parts of the pair of contact arms apart from the vertical parts in the width direction of the connector body, and is integrated with a part of a bottom plate of the mating recess on both sides of the recess cover part.

In yet another connector, the bottom surface part is housed in a bottom plate opening formed in the bottom plate of the mating recess, and the upright part is housed in a side wall recess formed in an inner surface of a side wall of the mating recess.

In yet another connector, the bottom surface part is substantially L-shaped when viewed in a vertical direction and is elastically deformable such that the horizontal part is displaced outward in the width direction of the connector body, and the upright part is substantially S-shaped when viewed in a front-back direction and is elastically deformable such that the contact projection is displaced outward in the width direction of the connector body.

In yet another connector, the reinforcing bracket further includes: a pair of left and right side covering parts connected to both ends of the body part, the side covering parts extending toward the center in the longitudinal direction of the connector body; a side wall upper cover part connected to an upper end of the side covering part, the side wall upper cover part covering at least a part of an upper side of a side wall of the mating recess; and a through-hole formed in the body part; and the reinforcing bracket is a member integrated with the connector body by insert molding.

A connector pair includes the connector according to the present disclosure and a counterpart connector that mates with the connector.

In the present disclosure, a connecter can be provided so that the interval between protrusions where the plurality of terminals is mounted can be narrowed, simplifying manufacturing, reducing size, and improving reliability.

BRIEF DESCRIPTION OF DRAWINGS

FIG. 5A is a top view and FIG. 5B is a front view.

DETAILED DESCRIPTION OF EMBODIMENTS

An embodiment will be described in detail below with reference to the drawings.

Figure 1:
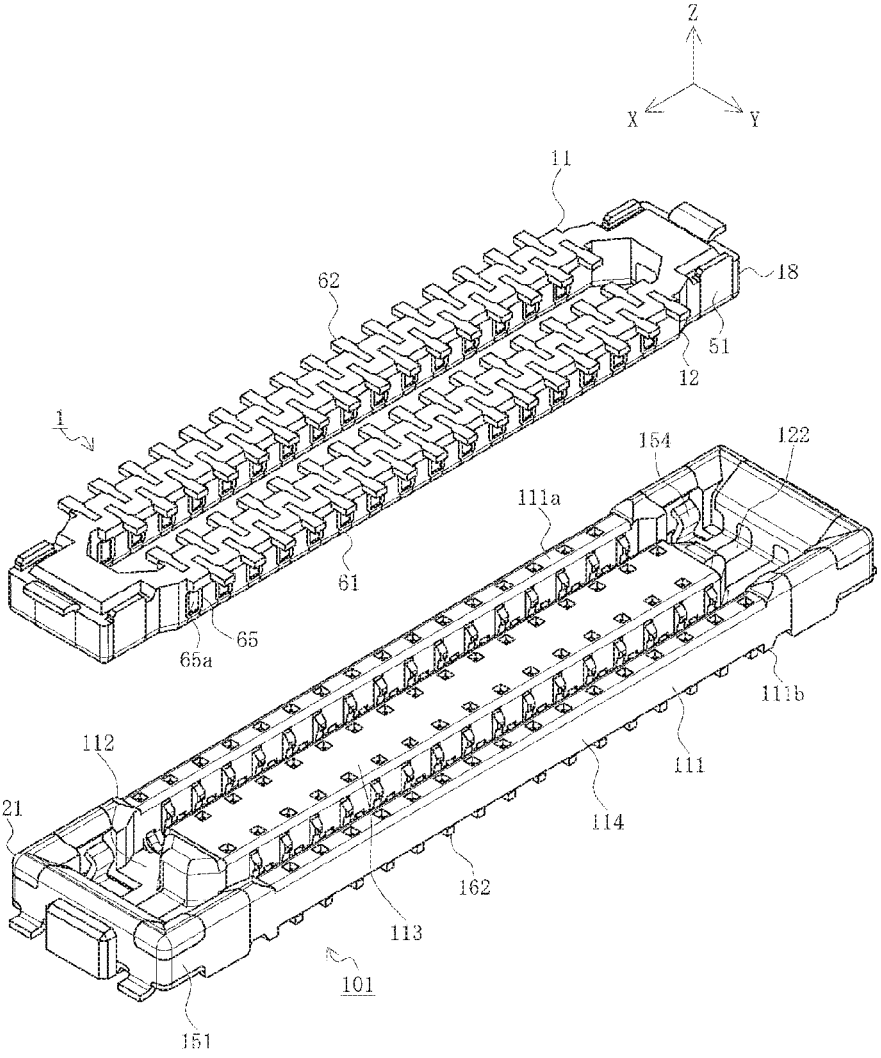
FIG. 1 is a perspective view illustrating the state immediately before mating of a first connector with a second connector according to the present embodiment when viewed from the first connector side.
Figure 2:
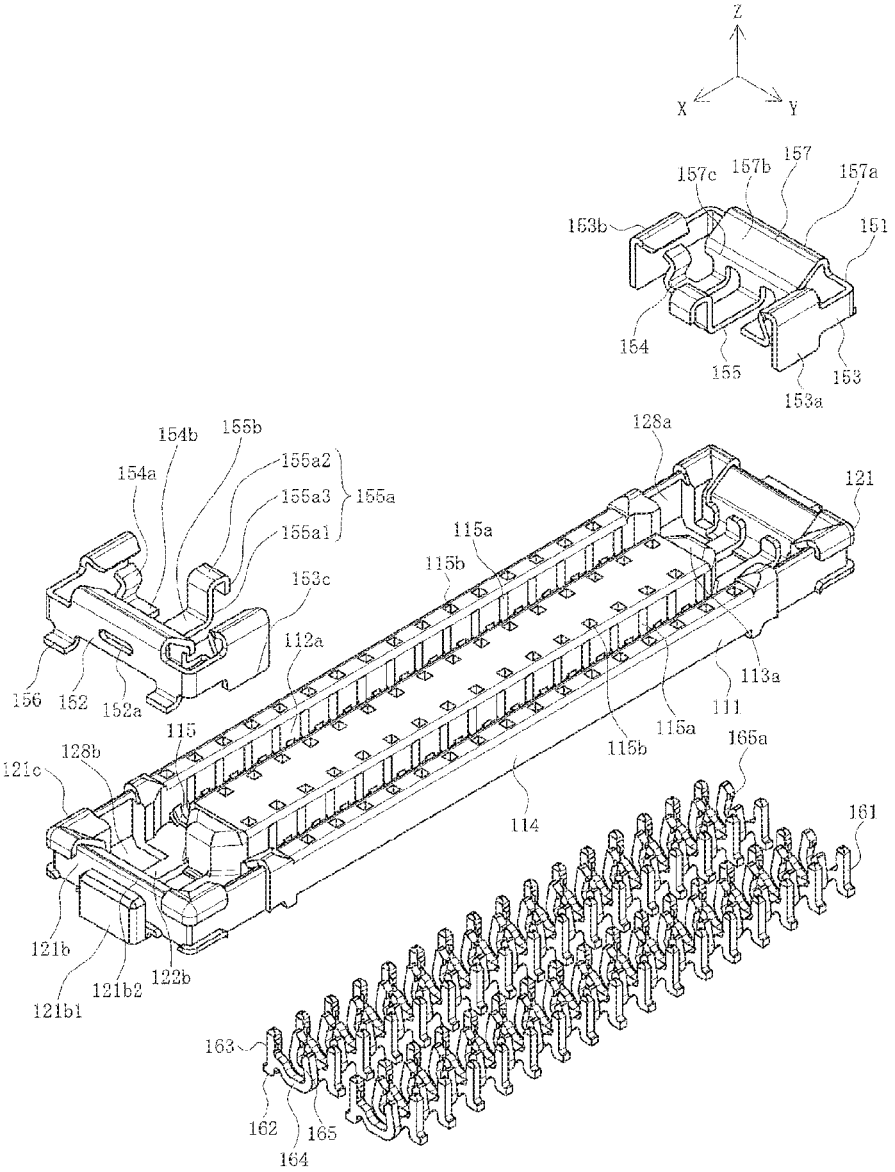
FIG. 2 is an exploded view illustrating the second connector according to the present embodiment.
Figure 3:
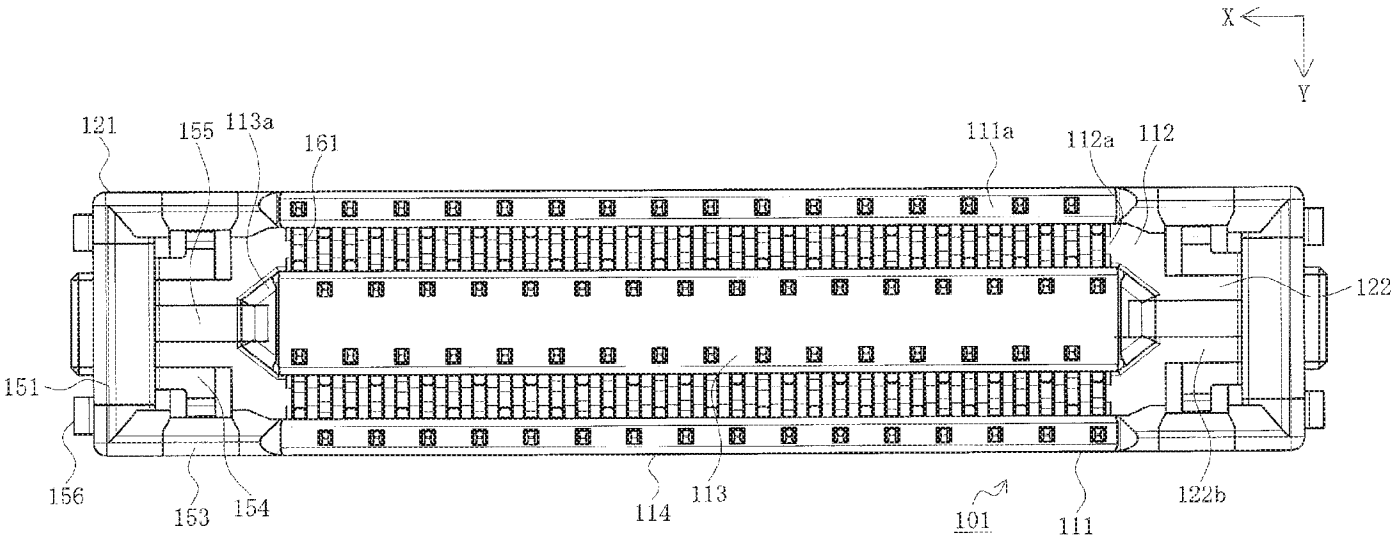
FIG. 3 is a top view illustrating the second connector according to the present embodiment.
Figure 4:
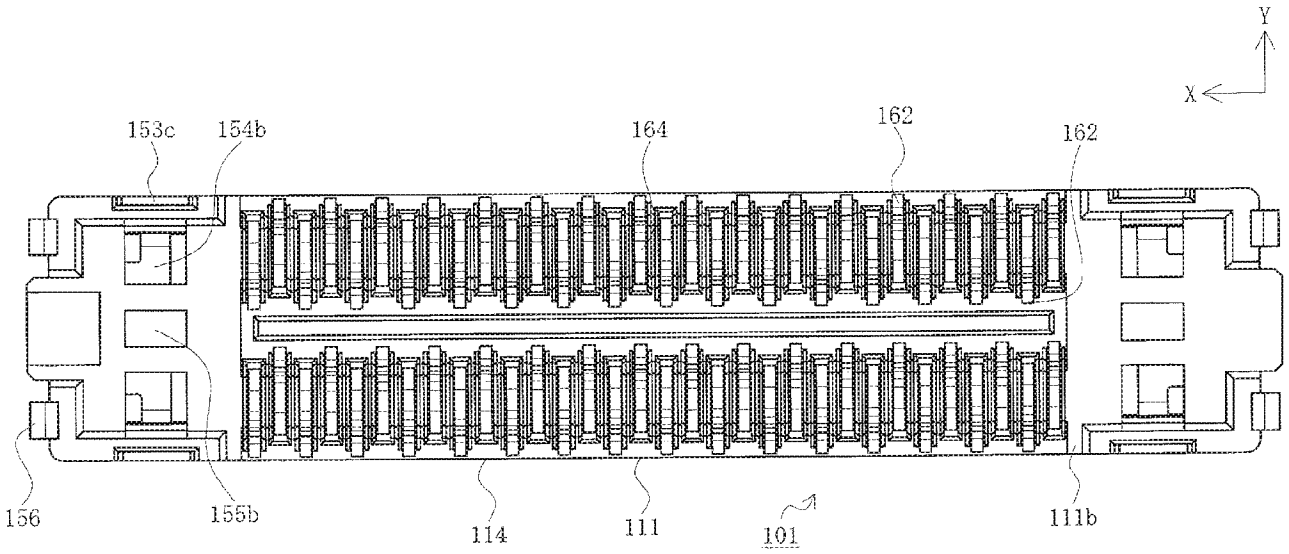
FIG. 4 is a bottom view illustrating the second connector according to the present embodiment.
Figure 5A:
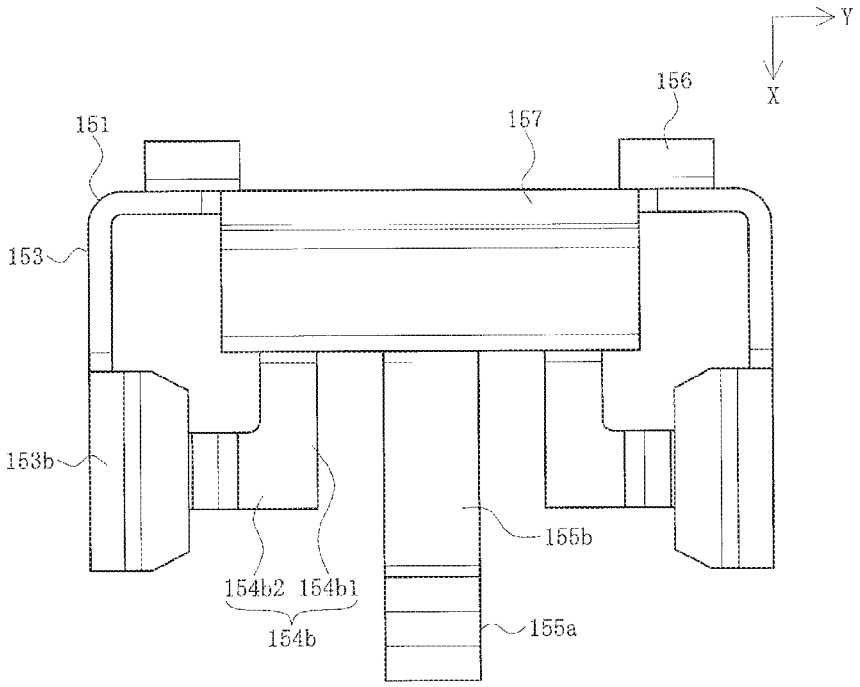
FIGS. 5A and 5B are two-sided views illustrating a second reinforcing bracket of the second connector according to the present embodiment.
Figure 5B:
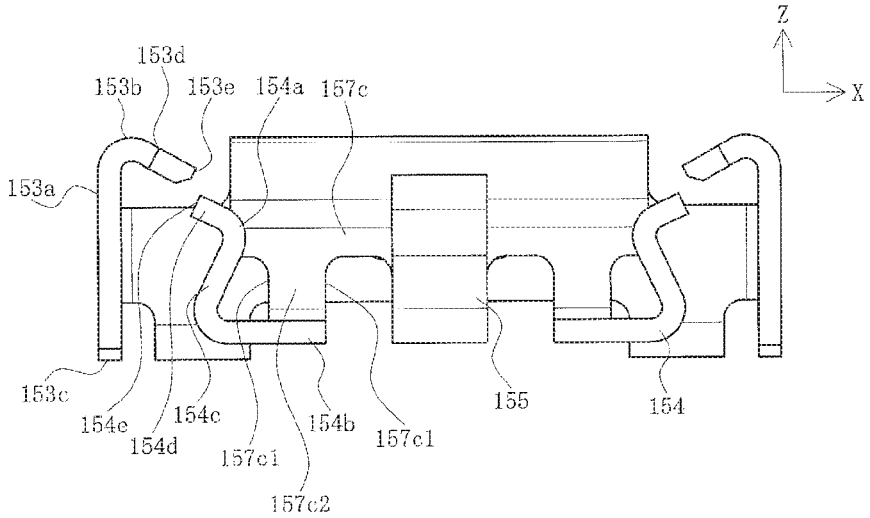

FIG. 1 is a perspective view illustrating the state immediately before mating of a first connector with a second connector according to the present embodiment when viewed from the first connector side, FIG. 2 is an exploded view illustrating the second connector according to the present embodiment, FIG. 3 is a top view illustrating the second connector according to the present embodiment, FIG. 4 is a bottom view of the second connector according to the present embodiment, and FIGS. 5A and 5B are two-sided views illustrating a second reinforcing bracket of the second connector. Note that FIG. 5A is a top view, and FIG. 5B is a front view.

In the figures, 101 is a second connector of a pair of board to board connectors which is a connector according to the present embodiment. The second connector 101 is a surface mount type connector to be mounted on the surface of a second substrate that is a substrate (not illustrated) serving as a mounting member and is mated with a first connector that is a counterpart connector described later. The first connector 1 is the other of the pair of board to board connectors and is a surface mount type connector to be mounted on the surface of the first substrate (not illustrated) serving as a mounting member.

Note that while the first connector 1 and the second connector 101 are ideally used for electrically connecting the first substrate and the second substrate serving as substrates, the connectors can also be used to electrically connect other members. Examples of the first substrate and the second substrate include printed circuit boards, flexible flat cables (FFC), flexible printed circuit boards (FPC), etc. used in electronic equipment, etc., but may be any type of substrate.

Furthermore, expressions indicating directions such as up, down, left, right, front, and back used to describe the operations and configurations of the parts of the first connector 1 and the second connector 101 in the present embodiment are not absolute but rather relative directions, and though appropriate when the parts of the first connector 1 and the second connector 101 are in the positions illustrated in the figures, these directions should be interpreted differently when these positions change in order to correspond to said change.

The second connector 101 has a second housing 111 that is a connector body integrally formed of an insulating material such as synthetic resin. As illustrated in the figure, this second housing 111 is a substantially rectangular body with the shape of a substantially rectangular thick plate. In addition, a substantially rectangular enclosed recess 112 that mates with the first housing 11 is formed on the side into which the first connector 1 of the second housing 111 is fitted, that is, the side of a mating surface 111*a* (Z-axis positive direction side). In addition, a second projection 113 that is an island part that mates with a recessed groove 13 described later is formed in the recess 112 integrally with the second housing 111, and side wall parts 114 extending parallel with the second projection 113 are formed on both sides of the second projection 113 integrally with the second housing 111.

The second projection 113 and the side wall parts 114 protrude upward (in the Z-axis positive direction) from the bottom surface of the recess 112, and extend in the longitudinal direction of the second connector 101. As a result, recessed grooves 112*a* that are narrow recesses extending in the longitudinal direction (X-axis direction) of the second connector 101 are formed as a part of the recess 112 on both sides of the second projection 113.

Second terminal housing groove cavities 115*a* in the shape of recessed grooves are formed on both side surfaces of the second projection 113 and the inner side surfaces of the side wall parts 114. In addition, second terminal housing hole cavities 115*b* in the shape of hole are formed in the second projection 113 and the side wall parts 114. Since the second terminal housing groove cavities 115*a* are integrally coupled to the second terminal housing hole cavities 115*b* on the bottom surface of the recessed groove 112*a*, the second terminal housing groove cavity 115*a* and the second terminal housing hole cavity 115*b* are collectively described, and the cavities are described as the second terminal housing cavity 115. Furthermore, a second terminal 161 that is a terminal is housed in each of the second terminal housing cavities 115. Thus, the plurality of (32 in the example illustrated in the figures) second terminals 161 is aligned at a predetermined pitch in each recessed groove 112*a*.

The second terminal 161 is a member integrally formed by applying a process such as punching or the like to a conductive metal plate, and includes a body part 163, a tail part 162 connected to the lower end of the body part 163, a connection part 164 that extends from the vicinity of the lower end of the body part 163 in the width direction (Y-axis direction) of the second connector 101, and a contact part 165 that extends upward (in the Z-axis positive direction) from that connection part 164. It is preferable that a contact projection 165*a* that extends towards the body part 163 is formed in the vicinity of a tip of the contact part 165.

The body part 163 is a part that is press-fit and retained in the second terminal housing hole cavity 115*b*. The tail part 162 is bent and connected to the lower end of the body part 163, extends in the width direction of the second housing 111, and is connected to a connection pad coupled to a conductive trace on the second substrate by soldering or the like. Note that the conductive trace is typically a signal line. The contact part 165 is a part that comes into contact with the first terminal 61 equipped on the first connector when the first connector 1 is mated with the second connector 101, and the contact projection 165*a* preferably engages with the contact recess 65*a* formed on the contact part 65 of the first terminal 61.

The second terminal 161 is inserted into the second terminal housing cavity 115 from below the second housing 111, and is attached to the second housing 111. Thus, in the second terminal 161, the body part 163 is press-fit and retained in the second terminal housing hole cavity 115*b*, the contact part 165 is housed in the second terminal housing groove cavity 115*a* and exposed to the recessed groove 112*a*, and the lower surface of the tail part 162 is exposed to the mounting surface 111*b* that is the lower surface of the second housing 111.

The second terminals 161 attached to the respective recessed grooves 112*a* are oriented such that the adjacent second terminals 161 face in opposite directions in the width direction of the recessed groove 112*a*. In the examples illustrated in FIGS. 1 to 4, the second terminal 161 positioned on the front end (end in the X-axis positive direction) of the second terminals 161 attached to the recessed grooves 112*a* on the side in the Y-axis positive direction is oriented such that the tail part 162 projects in the Y-axis negative direction, while the second terminal 161 positioned the second from the front end is oriented such that the tail part 162 projects in the y-axis positive direction. In this manner, as the second terminals 161 are attached to the recessed groove 112*a* so as to be alternately oriented in opposite directions, the pitch of the tail parts 162 exposed on the mounting surface 111*b* on both sides of the recessed groove 112*a* is set to twice the pitch of the second terminals 161. Therefore, connection work by soldering or the like to the connection pad of the second substrate can easily be performed. In addition, the pitch of the contact parts 165 exposed on the recessed groove 112*a* is also set to twice the pitch of the second terminals 161.

Moreover, a second protruding end part 121 that is a mating guide part is disposed on both longitudinal ends of the second housing 111. A mating recess 122 that is a part of the recess 112 is formed on each of the second protruding end parts 121. The mating recess 122 is a substantially rectangular recess connected to both longitudinal ends of the recessed groove 112*a*. Additionally, in the state where the first connector 1 is mated with the second connector 101, a first protruding end part 18 that is a counterpart mating guide part of the first connector 1 is inserted into the mating recess 122.

Furthermore, the second reinforcing bracket 151 that is a reinforcing bracket is a member integrally formed by performing a process such as punching, bending or the like on the metal plate, and includes a second body part 152 that is a body part extending in the width direction of the second housing 111 and covering the outside of the end wall part 121*b* of the second protruding end part 121, a side covering parts 153 connected to both left and right ends of the second body part 152, a pair of left and right tail parts 156 connected to the lower end of the second body part 152, an end wall cover part 157 connected to the upper end of the second body part 152, a recess cover part 155 connected to the end wall cover part 157, and contact arms 154 that are a pair of left and right elastic members.

Note that the second reinforcing bracket 151 is integrally formed with the second housing 111 by a molding method referred to as overmolding, outsert molding, or insert molding (hereinafter referred to as "insert molding") to be integrally attached to the second protruding end part 121. Thus, it should be noted that the second reinforcing bracket is not present at a distance from the second housing 111, and the location where the second reinforcing bracket 151 is attached in the second housing 111 is not present in the shape illustrated in FIG. 2 in the state separated from the second reinforcing bracket 151, and the drawing of FIG. 2 is merely done for convenience of description.

A through-hole 152*a* that penetrates the second body part 152 in the plate thickness direction is formed in the second body part 152, and an end wall outer part 121*b*1 that is an outer part of the end wall part 121*b* and the end wall inner part 121*b*2 that is the inner part of the end wall part 121*b* are connected to each other through the through-hole 152*a*. As a result, the end wall part 121*b* is firmly integrated with the second body part 152 of the second reinforcing bracket 151, and exhibits high strength even when the second connector 101 has a small longitudinal dimension and is thin.

The tail part 156 extends outward in the longitudinal direction of the second connector 101, and is connected and fixed to the connection pad (not illustrated) exposed on the surface of the second substrate by soldering or the like. Furthermore, for example, the connection pad is preferably coupled with the conductive trace, which is a power line.

A substantially rectangular flat plate-shaped side plate part 153*a* is formed on a tip of each side covering part 153, and a side wall upper cover part 153*b* is connected to the upper end of the side plate part 153*a*. The side plate part 153*a* is sized so as to cover at least a half of the outer surface of a side wall extension 121*c* that is a side wall of the mating recess 122. In addition, the side wall upper cover part 153*b* is curved by 90 degrees or more so as to cover at least a half of the upper end of the side wall extension 121*c*, and a tip 153*e* thereof extends diagonally downward toward the mating recess 122, and the vicinity of the tip 153*e* is an inclined surface part 153*d*. Note that, as necessary, a lower end 153*c* of the side plate part 153*a* may approach or contact the surface of the second substrate. In this case, the lower end 153*c* is connected to the connection pad on the second substrate by soldering, or the like, improving the connection strength of the second reinforcing bracket 151 to the second substrate.

The end wall cover part 157 includes an end wall upper cover part 157*a* that is bent and connected to the upper end of the second body part 152 and extends in the width direction of the second housing 111 to cover most of the upper surface of the end wall part 121*b*, an inclined surface part 157*b* that extends diagonally downward from the lower end of the end wall upper cover part 157*a* into the mating recess 122, and the lower end part 157*c* that linearly extends downward from the lower end of the inclined surface part 157*b*.

Note that the lower end part 157*c* does not necessarily extend linearly downward, and may be an inclined surface continuing from the inclined surface part 157*b*, for example.

The recess cover part 155 connected to the lower end part 157*c* includes a coupling part 155*b* that extends directly from the lower end part 157*c* toward an island end part 113*a* that is an end part of the second projection 113, which is an island part facing the end wall part 121*b*, and an island end cover part 155*a* connected to the tip of the coupling part 155*b*. The coupling part 155*b* is an elongate, band-like plate material extending through the center in the width direction of the mating recess 122 in the longitudinal direction of the second connector 101, and the upper surface thereof is flush with the upper surface of a bottom plate 122*b* of the mating recess 122. The bottom plate 122*b* extends in the longitudinal direction of the second connector 101 along both sides of the coupling part 155*b*, and couples the lower end of the end wall part 121*b* and both sides of the lower end of the island end part 113*a*. Thus, when the second housing 111 is molded by insert molding, a melted insulating material injected into a cavity of a mold can smoothly flow through a place corresponding to the bottom plate 122*b* to fill the cavity without any gap in the cavity.

Further, the island end cover part 155*a* is a substantially J-shaped member having a side surface that rises from the tip of the coupling part 155*b*, and is integrated with the island end part 113*a* so as to cover at least a part of the surface of the island end part 113*a*.

Specifically, the island end cover part 155*a* includes an island end surface cover part 155*a*1 that is bent by approximately 90 degrees and connected to the tip of the coupling part 155*b* and vertically extends, an island end upper surface cover part 155*a*2 that is connected to the upper end of the island end cover part 155*a*1 and curved by approximately 180 degrees, and an island end sunk part 155*a*3 that extends downward from a tip of the island end upper surface cover part 155*a*2. When the second reinforcing bracket 151 and the second housing 111 are integrated, the whole of the island end sunk part 155*a*3 and a part of the island end upper surface cover part 155*a*2 are embedded in the island end part 113*a*. Also, most of the island end surface cover part 155*a*1 and the island end upper surface cover part 155*a*2 are exposed on the outer surface of the island end part 113*a*. Thereby, the island end part 113*a* is covered with the integrated island end cover part 155*a*, and thus is reliably protected. Additionally, on the both longitudinal ends of the second reinforcing bracket 151, the end wall cover part 157 is integrated with the end wall part 121*b* and the island end cover part 155*a* is integrated with the second projection 113, improving the strength of the second reinforcing bracket 151.

The contact arms 154 are connected to the lower end parts 157*c* of the end wall cover part 157 at positions separated from the recess cover part 155 on both left and right sides of the recess cover part 155. The contact arms 154 each include a substantially L-shaped flat plate-like bottom surface part 154*b* when viewed in the vertical direction (Z-axis direction), and an upright part 154*c* that extends upward from a tip of the bottom surface part 154*b*. The upright part 154*c* is a plate material curved substantially into an S-shape when viewed in the front-rear direction (X-axis direction). Furthermore, the upright part 154*c* includes a contact projection 154*a* that is a contact part formed at the vicinity of the upper end, that is, the tip of the upright part so as to expand toward the center in the width direction of the second housing 111, and an inclined part 154*d* that extends from the upper end of the contact projection 154*a*.

Specifically, the bottom surface part 154*b* includes a vertical part 154*b*1 that linearly extends from the lower end part 157*c* in parallel to the coupling part 155*b* of the recess cover part 155, and a horizontal part 154*b*2 that linearly extends from the tip of the vertical part 154*b*1 toward the left and right side wall extensions 121*c*. Note that the part of the lower end part 157*c* to which the vertical part 154*b*1 is connected is the bottom surface connection part 157*c*2, and notches 157*c*1 are formed on both left and right sides of the bottom surface connection part 157*c*2. The width of the bottom surface connection part 157*c*2 is equivalent to the width of the vertical part 154*b*1, such that the length of the vertical part 154*b*1 is substantially extended, and the bottom surface part 154*b* is more likely to be elastically deformed. As illustrated in FIG. 5B, the vicinity of the lower end of the upright part 154*c* is curved and connected to a tip of the horizontal part 154*b*2 when viewed in the front-back direction, and extends diagonally upward toward the center in the width direction of the second housing 111. The contact projection 154*a* formed in the vicinity of the upper end of the upright part 154*c* is a part curved so as to protrude toward the center in the width direction of the second housing 111, and the contact projection 154*a* comes into contact with the first reinforcing bracket 51 attached to the first protruding end part 18 when the first connector 1 is mated with the second connector 101 and the first protruding end part 18 of the first connector 1 is inserted into the mating recess 122. Furthermore, the inclined part 154*d* extends diagonally upward from the upper end of the contact projection 154*a*toward the outer side in the width direction of the second housing 111, and the tip thereof is the tip 154*e* of the contact arm 154 and is opposed proximate to the tip 153*e* of the side wall upper cover part 153*b* of the side covering part 153.

In this manner, the tip 154*e* of the contact arm 154 is opposed proximate to the tip 153*e* of the side wall upper cover part 153*b*, and the upper surface of the inclined part 154*d* is substantially parallel to the inclined surface part 153*d* of the side wall upper cover part 153*b*, however, the upper surface of the inclined part 154*d* is offset below the inclined plane on which the inclined surface part 153*d* of the side wall upper cover part 153*b* is present. Accordingly, when the first protruding end part 18 is inserted into the mating recess 122, the first reinforcing bracket 51 first slides along the inclined face part 153*d* against the inclined surface part 153*d* of the side wall upper cover part 153*b*, and then slides against the inclined part 154*d* of the contact arm 154, preventing a large downward force from acting on the contact projection 154*a* to prevent buckling of the upright part 154*c*.

In the present embodiment, the coupling part 155*b* of the recess cover part 155 is integrated with the bottom plate 122*b* of the mating recess 122 present on both the left and right sides thereof, however, the bottom surface parts 154*b* of the left and right contact arms 154 are housed in a bottom plate opening 128*b* that penetrates the bottom plate 122*b* in the plate thickness direction (Z-axis direction), and are not integrated with the bottom plate 122*b*. The upright part 154*c* of the contact arm 154 is also housed in the bottom plate opening 128*b* and a side wall recess 128*a* formed on the inner surface of the side wall extension 121*c* so as to be continuous with the bottom plate opening 128*b*, and is not integrated with each part of the second protruding end part 121 such as the bottom plate 122*b*, the side wall extension 121*c*, and the like. In other words, the contact arm 154 is not integrated with the second housing 111, and is housed in the bottom plate opening 128*b* and the side wall recess 128*a* in the elastically deformable state.

When the first connector 1 is mated with the second connector 101 and the first protruding end part 18 of the first connector 1 is inserted into the mating recess 122, the left and right contact projections 154*a* are pushed outward in the width direction of the second housing 111. In this case, the left and right upright parts 154*c* elastically deform, and the bottom surface part 154*b* also deforms. For example, in FIG. 5B, the left and right upright parts 154*c* elastically change the inclination angle so as to increase the distance between the contact projections 154*a* formed near the upper ends of the upright parts. In addition, in FIG. 5A, the left and right bottom surfaces 154*b* elastically deform on the X-Y plane so as to increase the distance between the tips of the horizontal parts 154*b*2. As described above, in the present embodiment, the substantially L-shaped bottom surface part 154*b* also elastically deforms, and thus, functions as a spring over a long range from the base end of the bottom surface part 154*b* connected to the lower end part 157*c* of the end wall cover part 157 to the contact projection 154*a* near the upper end of the upright part 154*c*. Therefore, the contact arm 154 functioning as an elastic member has a long spring length, and thus may exert a spring force that can impart a contact pressure for reliably maintaining the contact projection 154*a* with the first reinforcing bracket 51, to the contact projection 154*a*.

Next, the configuration of the first connector 1 that constitutes a connector pair with the second connector 101, and the operation of mating the second connector 101 with the first connector 1 will be described.

Figure 6:
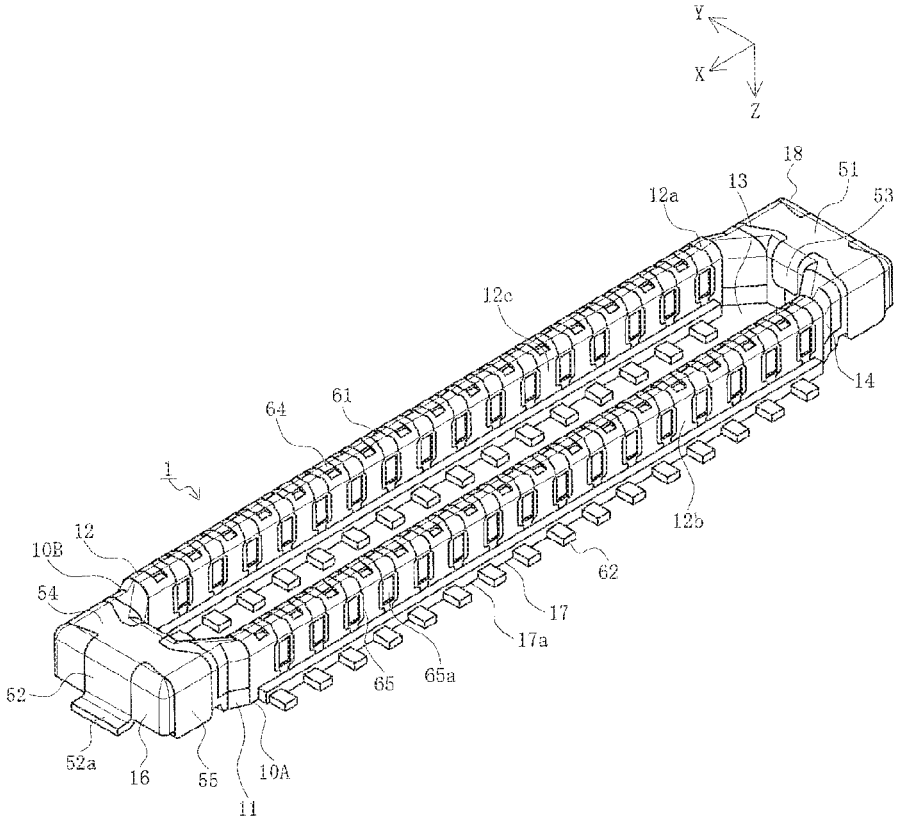
FIG. 6 is a perspective view illustrating the first connector according to the present embodiment.
Figure 7:
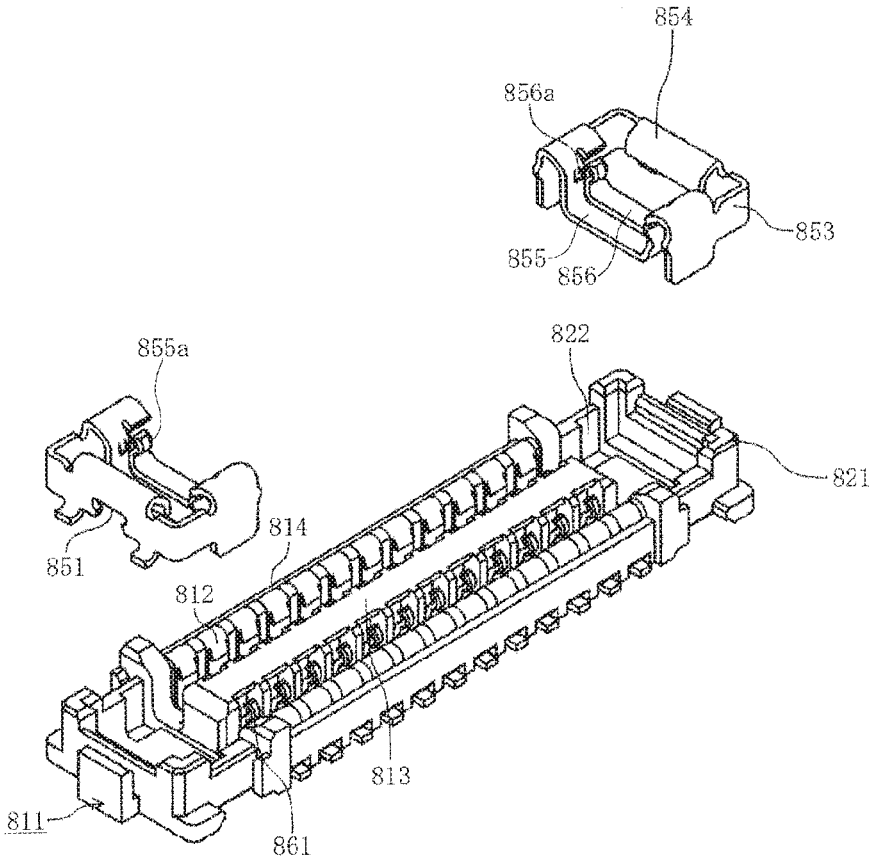
FIG. 7 is a partially exploded perspective view illustrating a known connector.

FIG. 6 is a perspective view illustrating the first connector according to the present embodiment.

The first connector 1 that is the counterpart connector according to the present embodiment is constituted by connecting a pair of left and right half body parts, that is, a left half body part 10A and a right half body part 10B using the first reinforcing bracket 51 that is a counterpart reinforcing bracket, and a covering part 16 integrally molded by insert molding. Note that the left half body part 10A and the right half body part 10B are identical members arranged as opposed to each other, and thus, when collectively described, are referred to as the half body part 10. The left half body part 10A and the right half body part 10B each are substantially gate-shaped in the plan view (shape projected onto the X-Y surface), and a space between the connected first half body part 10A and second half body part 10B is an elongated recessed groove 13 extending in the longitudinal direction (X-axis direction) of the first connector 1. This recessed groove 13 is a through-hole opened on the upper surface and lower surface of the first connector 1.

The half body parts 10 each are integrally formed from an insulative material such as a synthetic resin or the like, and have the first housing 11 that is substantially gate-shaped as a counterpart connector body. The first housings 11 each include an elongated band-like bottom plate part 17 that extends in the longitudinal direction (X-axis direction) of this first housing 11, and a first projection 12 as an elongated projection that is integrally formed with an upper surface of the bottom plate part 17 and extends in the longitudinal direction of the first housing 11. The first projection 12 is a member having an inverted U-shaped cross section, and has a curved mating surface 12*a* located on the upper side (in the Z-axis positive direction), and an outer surface 12*b* and an inner surface 12*c* that are connected to left and right sides of the mating surface 12*a*. The outer surface 12*b* and the inner surface 12*c* are a pair of flat surfaces that face each other in parallel, and extend in the longitudinal direction of the first housing 11. Since the dimension of the first projection 12 in the width direction (Y-axis direction) is smaller than the dimension of the bottom plate part 17 in the width direction, the bottom plate part 17 protrudes outward from the outer surface 12*b* and the inner surface 12*c* in the width direction at the lower end (end in the Z-axis positive direction) of the first projection 12. The lower surface of the bottom plate part 17 is a mounting surface 17*a* of the first housing 11 that faces the surface of the first substrate.

Each of the first projections 12 is provided with the first terminal 61 that is the counterpart terminal. The same number of first terminals 61 as the number of the second terminals 161 (32 in the example shown in the figures) are arranged at the same pitch as the pitch of the second terminals 161. The first terminal 61 is a member integrally formed by applying a process such as punching, bending or the like to a conductive metal plate, and includes a body part (not illustrated), a tail part 62 connected to one end of the body part, a contact part 65 that is bent by approximately 90 degrees, connected to the other end of the body part, and extends vertically, and an upper end part bent 64 that is bent by approximately 90 degrees and is connected to an upper end of the contact part 65.

The tail part 62 extends outward from the bottom plate part 17 in the width direction, and is connected to the connection pad coupled to the conductive trace on the first substrate by soldering or the like. Note that the conductive trace is typically a signal line. The contact part 65 is a part that comes into contact with the second terminal 161 of the second connector 101 when the first connector 1 is mated with the second connector 101, and preferably includes a contact recess 65*a* recessed from the surface.

In addition, the first terminal 61 is integrated with the first housing 11 by overmolding or insert molding. That is, first housing 11 is molded by filling the cavity of a mold, in which first terminal 61 has been set beforehand, with an insulating material. Thus, the first terminal 61 is integrally attached to the first housing 11 in the state where with the lower surface of the tail part 62 is exposed on the mounting surface 17*a* of the bottom plate part 17 and surfaces of the contact part 65 and the upper end part 64 are exposed on an outer surface 12*b* or an inner surface 12*c* and the mating surface 12*a* of the first projection 12.

Furthermore, the first terminals 61 attached to the first projection 12 are oriented such that adjacent terminals face in opposite directions in the width direction of the first projection 12. In the illustrated example, the first terminal 61 located at the front end (end in X-axis positive direction) among the first terminals 61 attached to the first projection 12 of the left half body part 10A is oriented such that the tail part 62 protrudes outward (in the Y-axis positive direction), while the first terminal 61 located the second from the front end is oriented such that the tail part 62 protrudes inward (in the Y-axis negative direction). In this manner, since the first terminals 61 are attached to the first projection 12 so as to be alternately oriented in opposite directions, the pitch of the tail parts 62 projecting from each side of the first projection 12 is twice the pitch of the first terminals 61. Therefore, connection work by soldering and the like to the connection pad of the first substrate can easily be performed. In addition, the pitch of the contact parts 65 exposed on the outer surface 12*b* of the first projection 12 and the contact part 65 exposed on the inner surface 12*c* are also twice the pitch of the first terminals 61.

A first protruding end part 18 that is a body end part functioning as a counterpart mating guide part is disposed on both longitudinal ends of the first projection 12. The first protruding end parts 18 are members connected to both longitudinal ends of each first projection 12, and are formed to connect the left half body part 10A to the right half body part 10B. In the state where the first connector 1 is mated with the second connector 101, the first protruding end part 18 functions as an insertion projection inserted into the mating recess 122 of the second protruding end part 121 of the second connector 101.

The first protruding end part 18 is constituted of extension end parts 14 of the left and right half body parts 10, a covering part 16, and a first reinforcing bracket 51.

An extension end part 14 extending in the longitudinal direction is integrally connected to both longitudinal ends of the first projection 12 of each of the half body parts 10. Note that the extension end parts 14 extend diagonally inward, and are located inward from the outer surface 12*b* of the first projection 12. In other words, the extension end part 14 of the left half body part 10A extends diagonally rightward (in the Y-axis positive direction). The extension end part 14 of the right half body part 10B extends leftward (in the Y-axis negative direction).

At least the vicinity of tips of the extension end parts 14 of the left and right half body parts 10 is covered with the covering part 16 formed from an insulating material such as a synthetic resin or the like. Specifically, the covering part 16 is formed by bringing at least the tips of the extension end parts 14 of the left and right half body parts 10 close to each other, and covering them with the first reinforcing bracket 51, and then performing insert molding in this state. In this manner, the extension end parts 14 of the left and right half body parts 10, the covering part 16, and the first reinforcing bracket 51 are integrated to form the first protruding end part 18, connecting the left and right half body parts 10 to each other.

The first reinforcing bracket 51 is a member integrally formed by applying a process such as punching, bending or the like to a metal plate, and includes a substantially rectangular upper plate 54 that extends in the width direction of the first housing 11, substantially rectangular legs 55 that are connected to both left and right edges of the upper plate 54 and extend downward, and an end wall outer surface covering part 52 and an end wall inner surface covering part 53 that are connected to both front and back edges of the upper plate 54 and extend downward. A tail part 52*a* is connected to the lower end of the end wall outer surface covering part 52. The width of the end wall outer surface covering part 52 is larger than the width of the end wall inner surface covering part 53.

As described above, the first reinforcing bracket 51 is integrated with the covering part 16 to constitute the first protruding end part 18. Then, the upper plate 54 is embedded in the upper surface of the first protruding end part 18, and the upper surface of the upper plate 54 is flush with the upper surface of the covering part 16, and constitutes most of the upper surface of the first protruding end part 18. The left and right legs 55 are embedded in the left and right outer surfaces of the first protruding end part 18, and the outer surfaces of the legs 55 are flush with the outer surface of the covering part 16, and constitute most of the outer surface of the first protruding end part 18. In addition, the end wall outer surface covering part 52 and the end wall inner surface covering part 53 are embedded in the end wall outer surface and the end wall inner surface of the first protruding end part 18, and the outer surfaces of the end wall outer surface covering part 52 and the end wall inner surface covering part 53 are flush with the end wall outer surface and the end wall inner surface of the covering part 16, and constitute most of the end wall outer surface and the end wall inner surface of the first protruding end part 18.

The tail part 52*a* is bent by approximately 90 degrees and connected to the lower end of the end wall outer surface covering part 52, extends outward in the longitudinal direction of the first housing 11, and is connected to the connection pad coupled with the conductive trace on the first substrate by soldering or the like. The conductive trace is typically a power line. Note that, as necessary, the lower ends of the legs 55 may approach or contact the surface of the first substrate. In this case, the connection strength of the first reinforcing bracket 51 to the first substrate is improved by connecting the lower ends of the legs 55 to the connection pad on the first substrate by soldering or the like.

The operation for mating the first connector 1 and the second connector 101 having the abovementioned configuration will be described next.

Here, the first connector 1 is mounted on the surface of the first substrate by connecting the tail parts 62 of first terminals 61 to the connection pad coupled to the conductive trace on the first substrate (not illustrated) by soldering or the like, and connecting the tail parts 52*a* of the first reinforcing bracket 51 to the connection pad coupled to the conductive trace on the first substrate by soldering or the like. It is assumed that the conductive trace coupled to the connection pad to which the tail parts 62 of the first terminals 61 are connected is a signal line, while the conductive trace coupled to the connection pad to which the tail parts 52*a* of the first reinforcing bracket 51 are connected is a power line.

Likewise, the second connector 101 is mounted on the surface of the second substrate by connecting the tail part 162 of second terminal 161 to the connection pad coupled to the conductive trace on the second substrate (not illustrated) by soldering or the like, and connecting the tail part 156 of the second reinforcing bracket 151 to the connection pad coupled to the conductive trace on the second substrate by soldering or the like. It is assumed that the conductive trace coupled to the connection pad to which the tail parts 162 of the second terminals 161 are connected is a signal line, while the conductive trace coupled to the connection pad to which the tail parts 156 of the second reinforcing bracket 151 are connected is a power line.

First, the operator places the mating surface 12*a* of the first projection 12, which is the mating surface of the first housing 11 of the first connector 1, and the mating surface

111*a* of the second housing 111 of the second connector 101 as opposed to each other, and when the position of the first projection 12 of the first connector 1 coincides with the position of the corresponding recessed groove 112*a* of the second connector 101, and the position of the first protruding end part 18 of the first connector coincides with the position of the corresponding mating recess 122 of the second connector 101, alignment of the first connector 1 with the second connector 101 is completed.

In this state, when the first connector 1 and/or the second connector 101 moves in the direction approaching the counterpart side—that is, the mating direction (Z-axis direction), the first projection 12 and the first protruding end part 18 of the first connector 1 are inserted into the recessed groove 112*a* and the mating recess 122 of the second connector 101. This completes the mating of the first connector 1 with the second connector 101. Then, the first terminals 61 become conductive with the second terminals 161, and the first reinforcing bracket 51 becomes conductive with the second reinforcing bracket 151.

Incidentally, since the first connector 1 and the second connector 101 are respectively mounted on the first and second substrates, which have wide areas, an operator cannot visually observe the mating surface of the first connector 1 and the mating surface of the second connector 101 and must perform the mating operation by trial and error. As a result, accurate alignment cannot be achieved due to the operation by trial and error, and the position of the first connector 1 and the position of the second connector 101 may be misaligned. For example, the second connector 101 may be misaligned in the X-axis direction or the Y-axis direction with respect to the first connector 1, resulting in a state where the mating recess 122 of the second connector 101 is displaced from the first protruding end part 18 of the first connector 1.

In such state, when the operator moves the first connector 1 and/or the second connector 101 in the mating direction, for example, the upper plate 54 of the first reinforcing bracket 51 that covers the first protruding end part 18 of the first connector 1 abuts the side wall extension 121*c* that defines the side of the mating recess 122, resulting in that the side wall extension 121*c* receives a strong downward pressing force. However, as described above, since the side wall upper cover part 153*b* of the second reinforcing bracket 151 covers at least a part of the upper side of the side wall extension 121*c*, the side wall extension 121*c* is not damaged or broken. Note that the end wall part 121*b* is also covered with the end wall cover part 157, and thus is not damaged or broken. Additionally, the end part of the second projection 113 is also covered with the island end cover part 155*a*, and thus is not damaged or broken.

Furthermore, since the end wall cover part 157 includes the inclined surface part 157*b*, the side wall upper cover part 153*b* includes the inclined surface part 153*d*, and the inclined surface part 157*b* and the inclined surface part 153*d* function as inviting surfaces, even when the first protruding end part 18 of the first connector 1 is displaced from the mating recess 122 of the second connector 101, the so-called self-alignment function automatically causes the first protruding end part 18 to be aligned with the mating recess 122 of the second connector 101, smoothly entering into the mating recess 122. Accordingly, the first connector 1 may be easily mated with the second connector 101.

As described above, in the present embodiment, the second connector 101 includes the second housing 111, the second terminals 161 attached to the second housing 111, and the second reinforcing bracket 151 attached to the second housing 111. The second housing 111 includes the second protruding end parts 121 that are formed on both longitudinal ends and have mating recesses 122 into which the first protruding end parts 18 formed on both longitudinal ends of the first housing 11 of the first connector 1 are inserted. The second reinforcing bracket 151 includes a second body part 152 that extends in the width direction of the second housing 111 and is attached to the outer side of the end wall part 121*b* of the second protruding end part 121, an end wall cover part 157 connected to the upper end of the second body part 152 and covers at least a part of the upper side and the inside of the end wall part 121*b*, and a pair of elastically deformable contact arms 154 connected to the lower end of the end wall cover part 157. Each of the contact arm 154 includes a bottom surface part 154*b* extending along the bottom surface of the mating recess 122 and an upright part 154*c* extending upward from the tip of the bottom surface part 154*b*. The bottom surface part 154*b* includes a vertical part 154*b*1 extending from the lower end of the end wall cover part 157 toward the center in the longitudinal direction of the second housing 111, and a horizontal part 154*b*2 extending from the tip of the vertical part 154*b*1 toward the outer side in the width direction of the second housing 111. The upright part 154*c* includes a contact projection 154*a* that is formed in the vicinity of the tip thereof and extends toward the center in the width direction of the second housing 111.

As a result, with a simple configuration, the spring length of the contact arm 154 can be ensured so as to exhibit a spring force required to apply a contact pressure to the contact projection 154*a*, enabling miniaturization of the second connector 101. In addition, the second connector 101 may be easily manufactured, and reliability of the second connector 101 is improved.

The second reinforcing bracket 151 includes the recess cover part 155 that is connected to the lower end of the end wall cover part 157 and covers at least a part of a bottom surface of the mating recess 122, and the recess cover part 155 is disposed between the vertical parts 154*b*1 of the pair of contact arms 154 apart from the vertical parts 154*b*1 in the width direction of the second housing 111, and is integrated with a part of the bottom plate 122*b* of the mating recess 122, which is located on both sides of the recess cover part 155. Thereby, the strength of the bottom plate 122*b* is improved, and when the second housing 111 is molded, the insulating material can smoothly flow to the place corresponding to the bottom plate 122*b* to fill the cavity of a mold without any gap.

Furthermore, the bottom surface part 154*b* is housed in a bottom plate opening 128*b* formed in the bottom plate 122*b* of the mating recess 122, and the upright part 154*c* is housed in the side wall recess 128*a* formed on the inner surface of the side wall extension 121*c* of the mating recess 122. Thus, the contact arms 154 are elastically deformable without interfering with parts of the second housing 111.

Furthermore, the bottom surface part 154*b* is substantially L-shaped as viewed from the vertical direction, and is elastically deformable such that the horizontal part 154*b*2 is displaced outward in the width direction of the second housing 111. The upright part 154*c* is substantially S-shaped when viewed from the front-back direction, and is elastically deformable such that the contact projection 154*a* is displaced outward in the width direction of the second housing 111. Therefore, the contact arm 154 functioning as an elastic member has a long spring length, and thus, may exert a spring force that can impart a sufficient contact pressure to the contact projection 154*a*.

Further, the second reinforcing bracket 151 further includes a pair of left and right side covering parts 153 that are connected to both ends of the second body part 152 and extend toward the center in the longitudinal direction of the second housing 111, a side wall upper cover part 153*b* that is connected to the upper end of the side covering part 153 and covers at least a part of the upper side of the side wall extension 121*c* of the mating recess 122, and a through-hole 152*a* formed in the second body part 152, and the second reinforcing bracket 151 is a member that is integrated with the second housing 111 by insert molding. As a result, the second protruding end part 121 of the second housing 111 is reliably integrated with the second reinforcing bracket 151, and the second protruding end part 121 has improved strength, and is not damaged or broken.

Note that the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification. For example, the staggered arrangement of the terminals does not have to be systematic. In addition, the arrangement of the terminals on the left and right half body parts does not need to be the same. Furthermore, the left and right half body parts do not need to be axially symmetric.

The invention claimed is:

1. A connector comprising:

a connector body;

a terminal attached to the connector body; and a reinforcing bracket attached to the connector body, wherein:

the connector body includes a mating guide part formed at a longitudinal end, the mating guide part including a mating recess into which a counterpart mating guide part formed on a longitudinal end of a counterpart connector body of a counterpart connector is configured to be inserted, the reinforcing bracket includes: a body part extending in a width direction of the connector body, the body part being attached to an outer side of an end wall part of the mating guide part; an end wall cover part connected to an upper end of the body part, the end wall cover part covering at least a part of an upper side and an inner side of the end wall part; and a pair of elastically deformable contact arms connected to a lower end of the end wall cover part, each of the contact arms includes: a bottom surface part extending along a bottom surface of the mating recess; and an upright part extending upward from a tip of the bottom surface part, the bottom surface part includes: a first part extending in the longitudinal direction from the lower end of the end wall cover part toward a center of the connector body; and a second part extending in the width direction from a tip of the first part toward an outer side of the connector body, whereby at least a portion of the second part is offset from the first part in the width direction, and the upright part includes a contact projection formed at a tip thereof, the contact projection extending in the width direction toward the center of the connector body.

2. The connector according to claim 1, wherein the reinforcing bracket includes a recess cover part connected to the lower end of the end wall cover part, the recess cover part covering at least a part of the bottom surface of the mating recess, and the recess cover part is disposed between the first parts of the pair of contact arms apart from the first parts in the width direction of the connector body, and is integrated with a part of a bottom plate of the mating recess on both sides of the recess cover part.

3. The connector according to claim 1, wherein the bottom surface part is housed in a bottom plate opening formed in the bottom plate of the mating recess, and the upright part is housed in a side wall recess formed in an inner surface of a side wall of the mating recess.

4. The connector according to claim 1, wherein the bottom surface part is substantially L-shaped when viewed in a vertical direction and is elastically deformable such that the second part is displaced outward in the width direction of the connector body, and the upright part is substantially S-shaped when viewed in a front-back direction and is elastically deformable such that the contact projection is displaced outward in the width direction of the connector body.

5. The connector according to claim 1, wherein the reinforcing bracket further includes: a pair of left and right side covering parts connected to both ends of the body part, the side covering parts extending in the longitudinal direction toward the center of the connector body; a side wall upper cover part connected to an upper end of the side covering part, the side wall upper cover part covering at least a part of an upper side of a side wall of the mating recess; and a through-hole formed in the body part; and the reinforcing bracket is a member integrated with the connector body by insert molding.

6. The connector according to claim 5, wherein the contact arms are not directly connected to any of the left and right side covering parts.

7. A connector pair comprising: the connector described in claim 1, and a counterpart connector that mates with the connector.

* * * * *